US005499405A

United States Patent [19]

Collins

[11] Patent Number: 5,499,405

[45] Date of Patent: Mar. 19, 1996

[54] URINAL

[76] Inventor: William T. Collins, 27216 112th St. E., Buckley, Wash. 98321

[21] Appl. No.: 340,604

[22] Filed: Nov. 16, 1994

[51] Int. Cl.[6] ..... E03D 13/00

[52] U.S. Cl. ..... 4/306; 4/348; 4/420

[58] Field of Search ..... 4/301, 306, 309, 4/311, 420, 348–352, 262

[56] References Cited

U.S. PATENT DOCUMENTS

| | | | |
|---|---|---|---|
| 889,916 | 6/1908 | Ebinger | 4/306 |
| 4,137,579 | 2/1979 | Soler | 4/311 |
| 4,180,875 | 1/1980 | Wilson | 4/311 X |

*Primary Examiner*—Charles E. Phillips

[57] ABSTRACT

A urinal for capturing and directing urine into a drain line. The inventive device includes an adjustable mounting structure securable to a wall surface within a bathroom. A urinal is supported by the adjustable mounting structure and can be positioned at a desired height. A water conduit communicates with a water supply line of a nearby sink or the like to permit selective flushing of the urinal, and a drain conduit communicates with a sink drain line to receive and dispose of the urine and flush water. The device can be readily installed into existing bathroom structures to provide an alternative to a conventional toilet, thereby reducing flushing of the toilet and saving water.

5 Claims, 6 Drawing Sheets

URINAL

BACKGROUND OF THE INVENTION

1. Field of the Invention

The present invention relates to toilet structures and more particularly pertains to a urinal for capturing and directing urine into a drain line.

2. Description of the Prior Art

The use of toilet structures is known in the prior art. More specifically, toilet structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art toilet structures include U.S. Pat. Nos. 5,153,947; 5,050,248; 4,612,676; 3,500,480; and U.S. Pat. No. Des. D,252,404.

While these devices fulfill their respective, particular objectives and requirements, the aforementioned patents do not disclose a urinal for capturing and directing urine into a drain line which includes an adjustable mounting structure securable to a wall surface, a urinal supported by the adjustable mounting structure so as to be positioned at a desired height, a water conduit communicating with a water supply line to permit selective flushing of the urinal, and a drain conduit communicating with a sink drain line to receive and dispose of the urine and flush water.

In these respects, the urinal according to the present invention substantially departs from the conventional concepts and designs of the prior art, and in so doing provides an apparatus primarily developed for the purpose of capturing and directing urine into a drain line.

SUMMARY OF THE INVENTION

In view of the foregoing disadvantages inherent in the known types of toilet structures now present in the prior art, the present invention provides a new urinal construction wherein the same can be utilized for capturing and directing urine into a drain line. As such, the general purpose of the present invention, which will be described subsequently in greater detail, is to provide a new urinal apparatus and method which has many of the advantages of the toilet structures mentioned heretofore and many novel features that result in a urinal which is not anticipated, rendered obvious, suggested, or even implied by any of the prior art toilet structures, either alone or in any combination thereof.

To attain this, the present invention generally comprises a urinal for capturing and directing urine into a drain line. The inventive device includes an adjustable mounting structure securable to a wall surface within a bathroom. A urinal is supported by the adjustable mounting structure and can be positioned at a desired height. A water conduit communicates with a water supply line of a nearby sink or the like to permit selective flushing of the urinal, and a drain conduit communicates with a sink drain line to receive and dispose of the urine and flush water. The device can be readily installed into existing bathroom structures to provide an alternative to a conventional toilet, thereby reducing flushing of the toilet and saving water.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new urinal apparatus and method which has many of the advantages of the toilet structures mentioned heretofore and many novel features that result in a urinal which is not anticipated, rendered obvious, suggested, or even implied by any of the prior art toilet structures, either alone or in any combination thereof.

It is another object of the present invention to provide a new urinal which may be easily and efficiently manufactured and marketed.

It is a further object of the present invention to provide a new urinal which is of a durable and reliable construction.

An even further object of the present invention is to provide a new urinal which is susceptible of a low cost of manufacture with regard to both materials and labor, and which accordingly is then susceptible of low prices of sale to the consuming public, thereby making such urinals economically available to the buying public.

Still yet another object of the present invention is to provide a new urinal which provides in the apparatuses and methods of the prior art some of the advantages thereof, while simultaneously overcoming some of the disadvantages normally associated therewith.

Still another object of the present invention is to provide a new urinal for capturing and directing urine into a sink drain line.

Yet another object of the present invention is to provide a new urinal which includes an adjustable mounting structure securable to a wall surface, a urinal supported by the adjustable mounting structure so as to be positioned at a desired height, a water conduit communicating with a water supply line to permit selective flushing of the urinal, and a drain conduit communicating with a sink drain line to receive and dispose of the urine and flush water.

Even still another object of the present invention is to provide a new urinal which can be readily installed into existing bathroom structures to provide an alternative to a conventional toilet, thereby reducing flushing of the toilet and saving water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
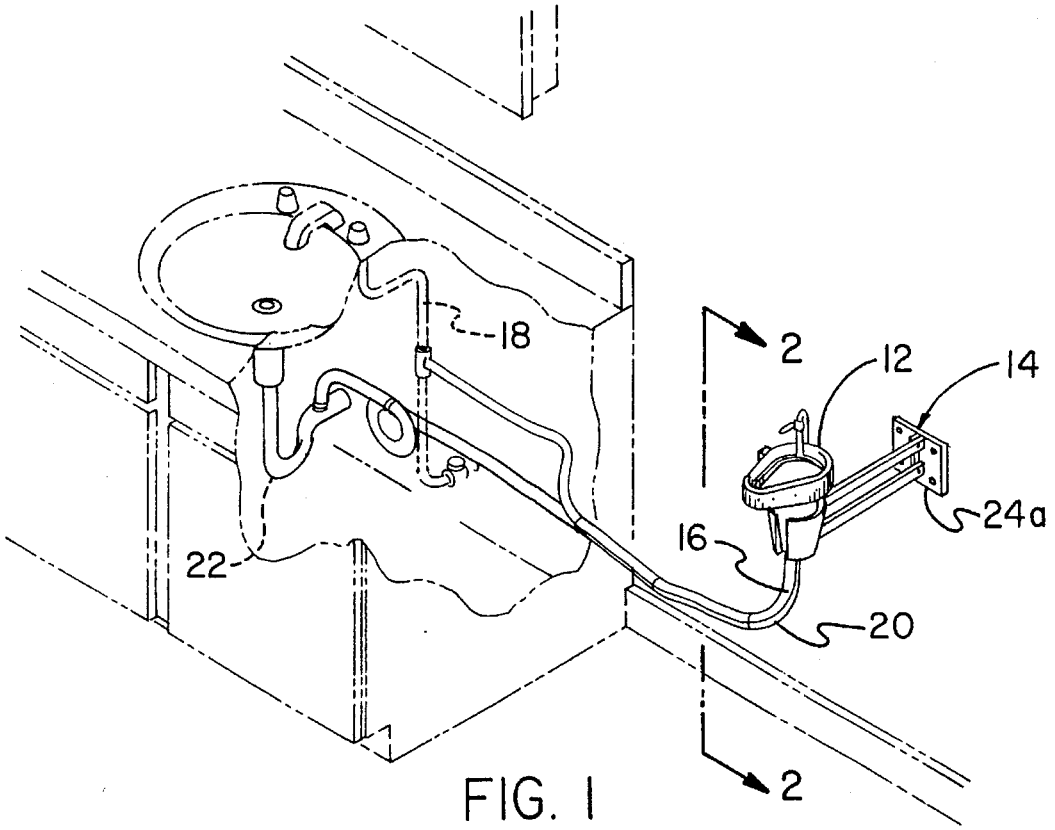
FIG. 1 is an isometric illustration of a urinal according to the present invention as installed within a bathroom structure.

With reference now to the drawings, and in particular to FIGS. 1–11 thereof, a new urinal embodying the principles and concepts of the present invention and generally designated by the reference numeral 10 will be described.

More specifically, it will be noted that the urinal 10 comprises a urinal bowl 12 and an adjustable mounting means 14 for adjust ably mounting the urinal bowl 12 to a vertical wall surface, as best illustrated in FIG. 1. A water conduit 16 is coupled to a water supply line 18 of a nearby bathroom fixture, such as the unlabelled sink shown in FIG. 1, and fluidly communicates therewith to permit selective flushing of the urinal 12. A drain conduit 20 extends from the urinal 12 and fluidly communicates with a sink drain line 22 of the sink or other bathroom fixture. By this structure, the urinal 12 may be utilized in lieu of a conventional toilet, thereby reducing flushing of the conventional toilet and saving water.

Figure 2:
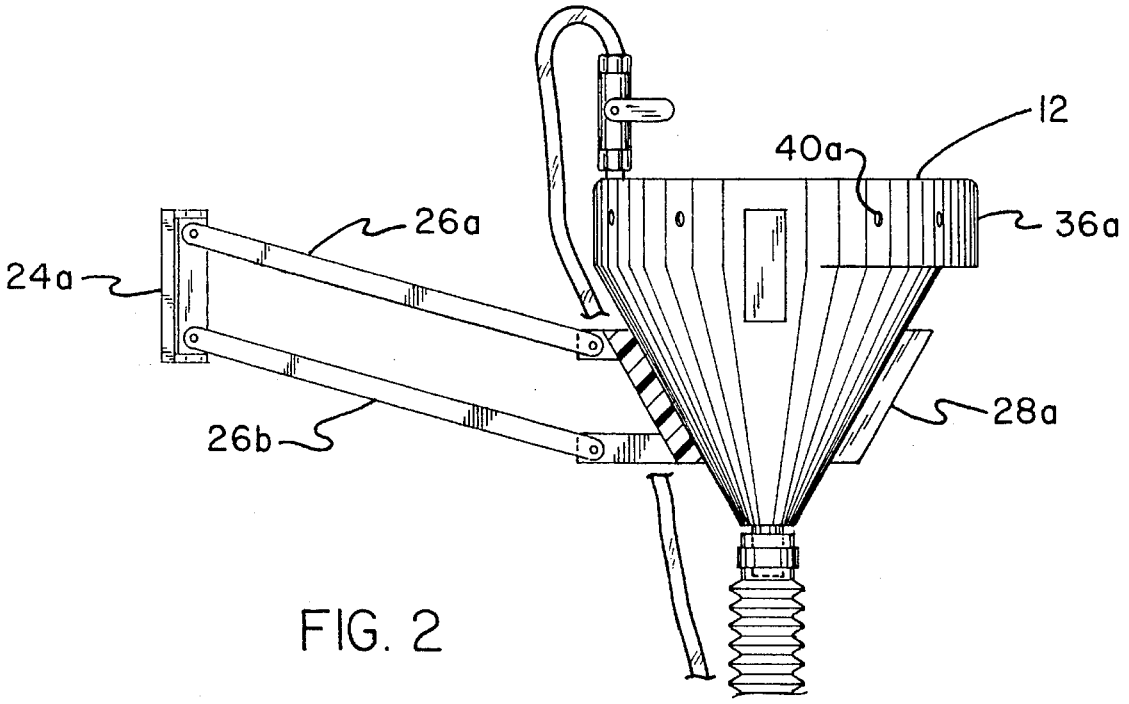
FIG. 2 is a side elevational view, partially in cross section, of the urinal.

As sown in FIGS. 1 and 2, the adjustable mounting means 14 comprises a mounting plate 24*a* having a plurality of through-extending apertures permitting the attachment of the mounting plate 24*a* to a vertical wall surface by a plurality of threaded fasteners for other fastening means. A first adjustment leg 26*a* is pivotally mounted to the mounting plate 24*a*, with a second adjustment leg 26*b* also being pivotally mounted to the mounting plate 24*a*. The first and second adjustment legs 26*a* and 26*b* project from the mounting plate 24*a* to pivotally couple with a conical receiver 28*a* which receives the urinal bowl 12 partially therewithin. By this structure, the adjustment legs 26*a* and 26*b* and the attached urinal bowl 12 may be positioned at a desired height relative to an unlabelled floor surface of the bathroom structure.

Figure 3:
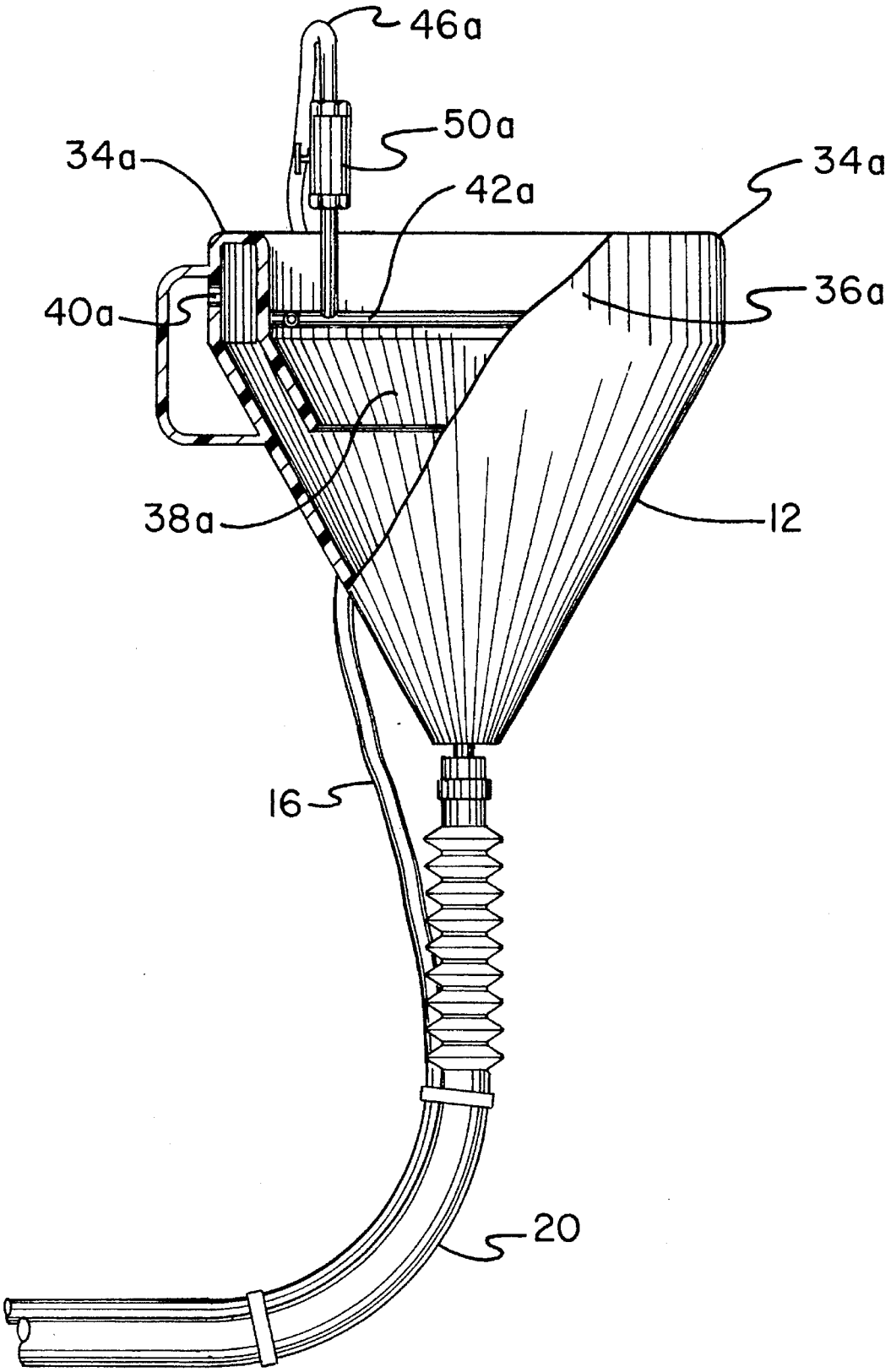
FIG. 3 is a front elevational view, partially in cross section, of the invention.
Figure 4:
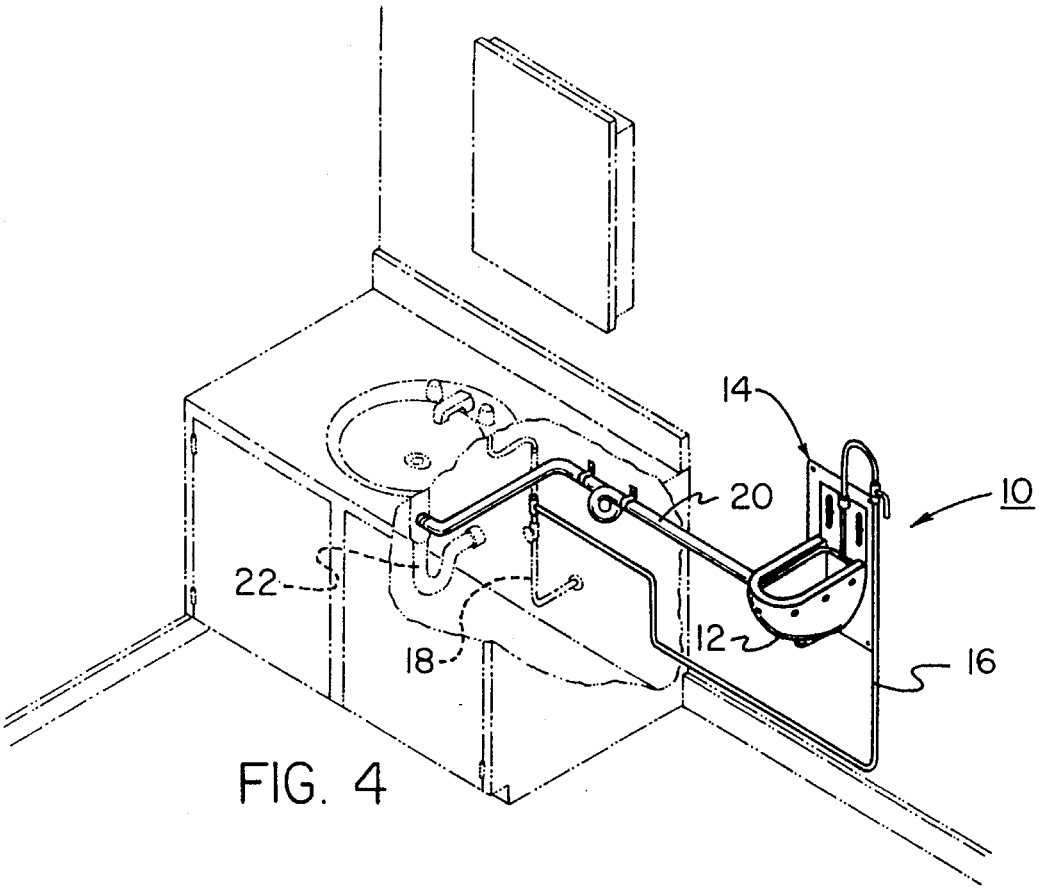
FIG. 4 is an isometric illustration of an alternative form of a urinal according to the present invention as installed within a bathroom structure.

Referring now to FIGS. 2 and 3, it can be shown that the urinal bowl 12 includes spaced side walls 34*a* which are connected together by an arcuate front end 36*a* of the urinal bowl. Preferably, the side walls 34*a* of the urinal bowl 12 are spaced a sufficient distance apart so as to accommodate the direction of urine from a female individual into the urinal bowl. The urinal bowl 12 is completed by a depending lip 38*a* which extends from an upper perimeter of the side walls 34*a* and the arcuate front end 36*a* and into an interior of the urinal bowl. The depending lip 38*a* is spaced from the interior surface of the urinal bowl 12, as shown in FIG. 3. A plurality of vent holes 40*a* extend through the urinal bowl 12 and into the space between the depending lip 38*a* and the interior surface of the urinal bowl 12. The vent holes 40*a* are operable to preclude cross connection of the drain conduit 20 to the water conduit 16. In other words, should the urinal bowl 12 become overfilled, the vent holes 40*a* will preclude communication of the liquids within the urinal bowl 12 with the water conduit 16. The vent holes 40*a* are further operable to draw ambient air into the urinal bowl 12 as flush water dispensed into the urinal bowl flows from the depending lip 38*a* to the interior surface of the urinal bowl. In other words, the flush water dispensed into the urinal bowl creates a venturi vacuum as the flush water falls from the depending lip 38*a* which will draw ambient air into the urinal bowl 12 through the vent holes 40*a*, thereby flushing and diluting any odors present within the urinal bowl.

To effect rinsing or flushing of the urinal bowl 12, a perimeter conduit 42*a* is mounted along an upper perimeter of the urinal bowl 12. The perimeter conduit 42*a* includes a plurality of spray holes which create a fine mist when a fluid such as water is directed through the perimeter conduit. A flexible conduit 46*a* extends into fluid communication with the perimeter conduit 42*a*. The flexible conduit 46 permits adjustment of the adjustment legs 26*a* relative to the mounting plate 24*a* and communicates with a flush valve 50*a* secured to the urinal bowl 12.

Figure 5:
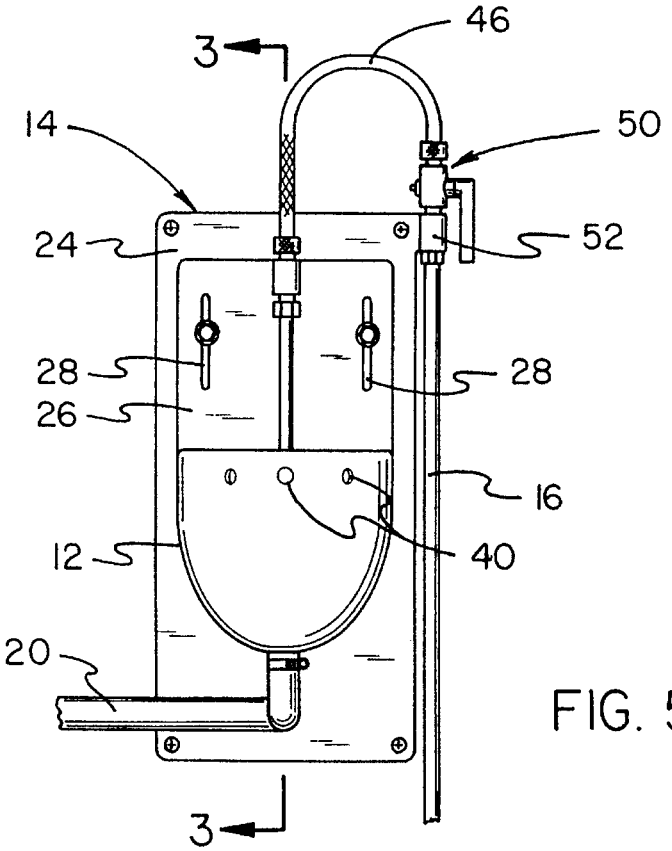
FIG. 5 is a front elevation view of the device.
Figure 6:
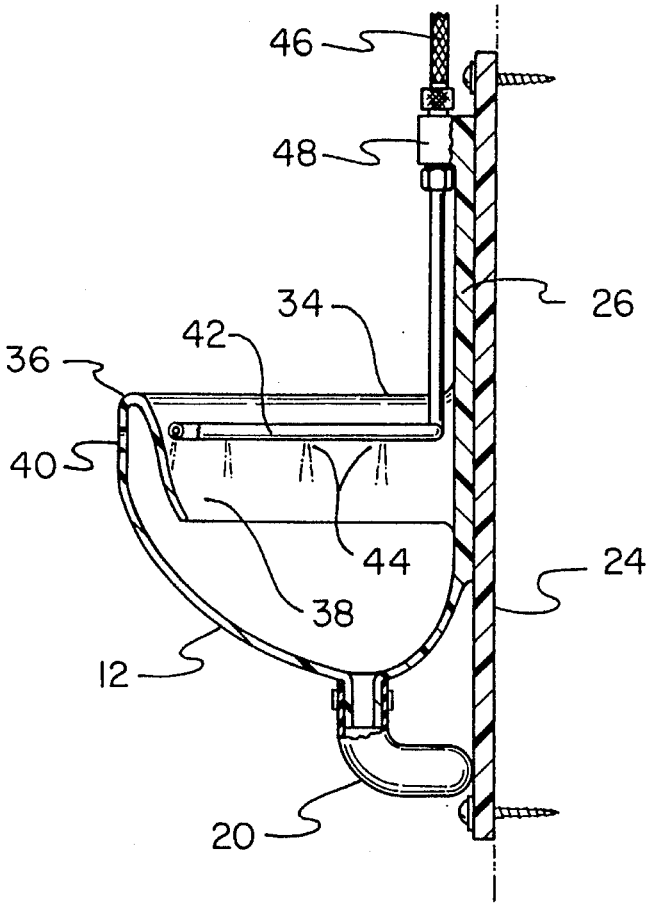
FIG. 6 is a cross-sectional view taken along line 3—3 of FIG. 2.
Figure 7:
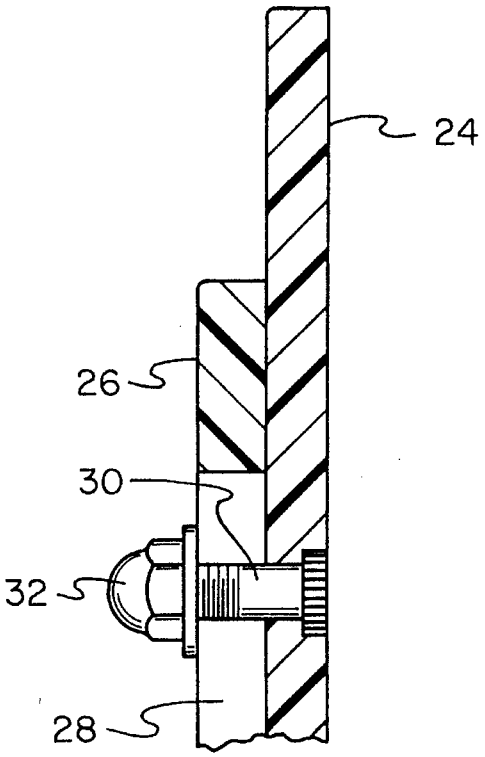
FIG. 7 is an enlarged cross-sectional view of a portion of the present invention.

An alternative form of the present invention is illustrated in FIGS. 4 through 11. As best illustrated in FIGS. 5 through 7, it can be shown that the adjustable mounting means 14 of the alternative form of the present invention 10 comprises a mounting plate 24 having a plurality of through-extending apertures permitting the attachment of the mounting plate 24 to a vertical wall surface by a plurality of threaded fasteners or other fastening means. An adjustment plate 26 having a pair of elongated apertures 28 extending in a vertical orientation is adjust ably coupled to the mounting plate 24 by a pair of threaded studs 30 which project through the respective elongated slots 28, with a securing nut 32 engaging the threaded stud 30 to capture the adjustment plate 26 between the securing nut and the mounting plate 24. The urinal bowl 12 is integrally or otherwise fixedly secured to the adjustment plate 26 and projects outwardly therefrom. By this structure, the adjustment plate 26 and the attached urinal bowl 12 may be positioned at a desired height relative to an unlabelled floor surface of the bathroom structure.

With continuing reference to FIGS. 5 and 6, it can be shown that the alternative form of the urinal bowl includes spaced and parallel side walls 34 which orthogonally project from the adjustment plate 26 and are connected together by an arcuate front end 36 of the urinal bowl. Preferably, the parallel side walls 34 of the urinal bowl 12 are spaced a distance apart so as to accommodate the direction of urine from a female individual into the urinal bowl. In other words, the parallel side walls 34 are preferably spaced a distance apart which permits the female individual to squat over the urinal bowl 12, whereby urine expelled from such female individual is received within the urinal bowl. The urinal bowl 12 is completed by a depending lip 38 which extends from an upper perimeter of the parallel side walls 34 and the arcuate front end 36 and into an interior of the urinal bowl. The depending lip 38 is spaced from the interior surface of the urinal bowl 12, as shown in FIG. 6. A plurality of vent holes 40 extend through the urinal bowl 12 and into the space between the depending lip 38 and the interior surface of the urinal bowl. The vent holes 40 are operable to preclude cross connection of the drain conduit 20 to the water conduit 16. In other words, should the urinal bowl 12 become overfilled, the vent holes 40 will preclude communication of the liquids within the urinal bowl 12 with the water conduit 16. The vent holes 40 are further operable to draw ambient air into the urinal bowl 12 as flush water dispensed through the spray holes 44 of the perimeter conduit 42 flows from the depending lip 38 to the interior surface of the urinal bowl. In other words, the flush water dispensed from the spray holes 44 creates a venturi vacuum as the flush water falls from the depending lip 38 which will draw ambient air into the urinal bowl 12 through the vent holes 40, thereby flushing and diluting any odors present within the urinal bowl.

Figure 8:
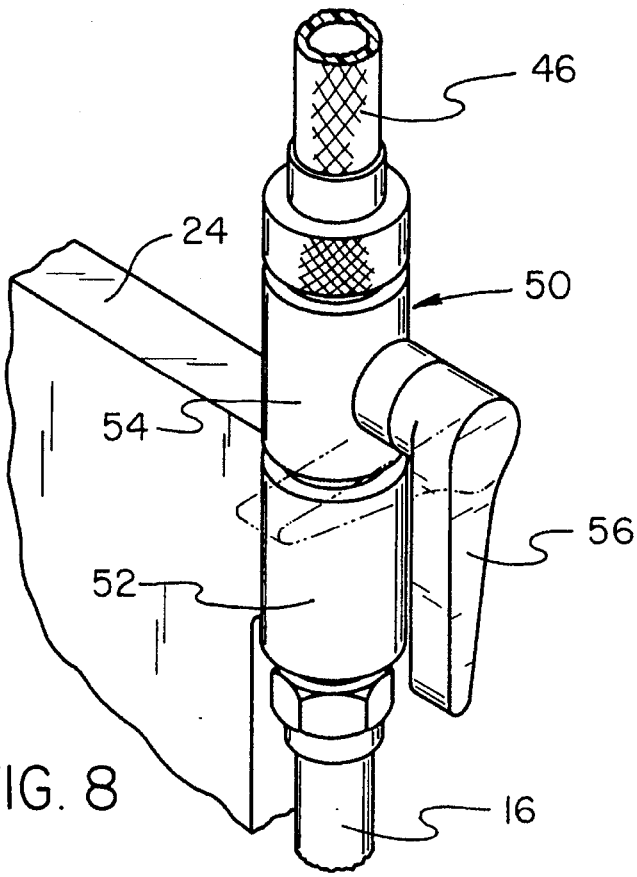
FIG. 8 is an enlarged isometric illustration of a further portion of the present invention.
Figure 9:
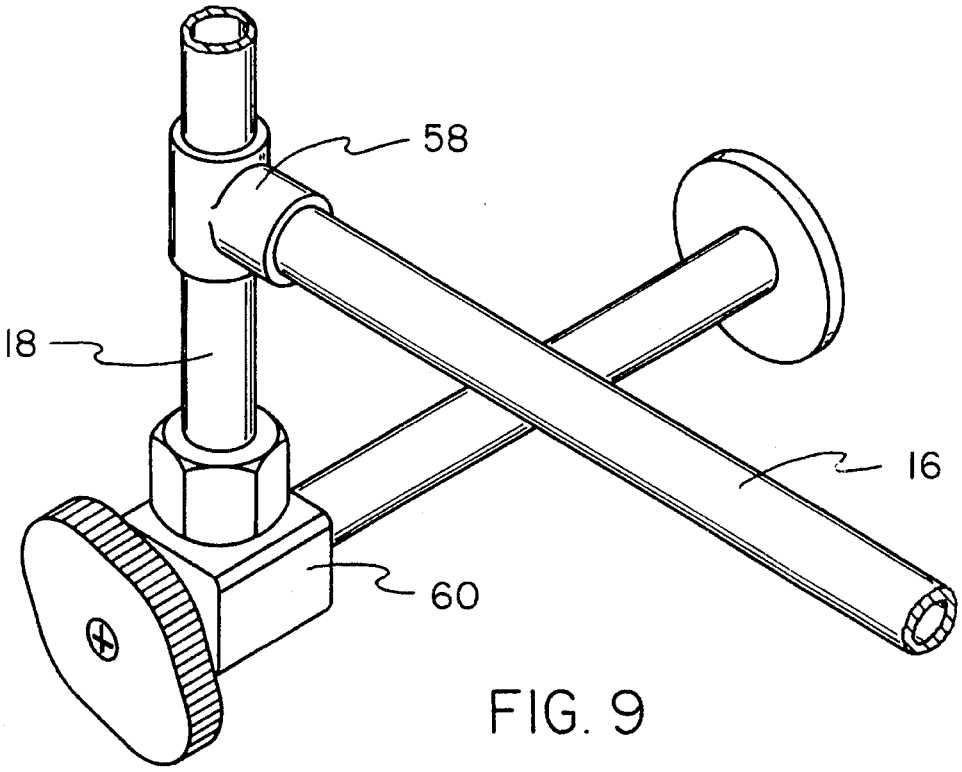
FIG. 9 is an isometric illustration detailing the connection of the water conduit to the water supply line.

To effect rinsing or flushing of the urinal bowl 12, a perimeter conduit 42 is mounted along an upper perimeter of the urinal bowl 12. The perimeter conduit 42 includes a plurality of spray holes 44 which create a fine mist when a fluid such as water is directed through the perimeter conduit. A flexible conduit 46 extends through a mounting collar 48 in the adjustment plate 26 and into fluid communication with the perimeter conduit 42. The mounting collar 48 mounts an upper distal end of the perimeter conduit 42 such that the perimeter conduit is supported along the upper portion of the urinal bowl 12 without any direct connection thereto. In other words, the perimeter conduit 42 is suspended within the opening of the urinal bowl, as shown in FIG. 6 by the mounting collar 48. The flexible conduit 46 permits adjustment of the adjustment plate 26 relative to the mounting plate 24 and communicates with a flush valve 50 secured to the mounting plate 24 by a further mounting collar 52. As shown in FIG. 8, the water conduit 16 extends through the mounting collar 52 and into communication with the flush valve 50. Preferably, the flush valve 50 comprises a ball valve 54 having a rotatable handle 56 which permits an individual to selectively flush the urinal bowl 12 for a desired length of time. As shown in FIG. 9, the water conduit 16 can be simply connected to the water supply line 18 of a nearby bathroom fixture by a supply line T-connector 58. Preferably, the water conduit 16 extends into communication with the water supply line 18 via the supply line T-connector 58 downstream of a supply line valve 60, such that the supply line valve 60 can be selectively closed for servicing of the urinal 10.

Figure 10:
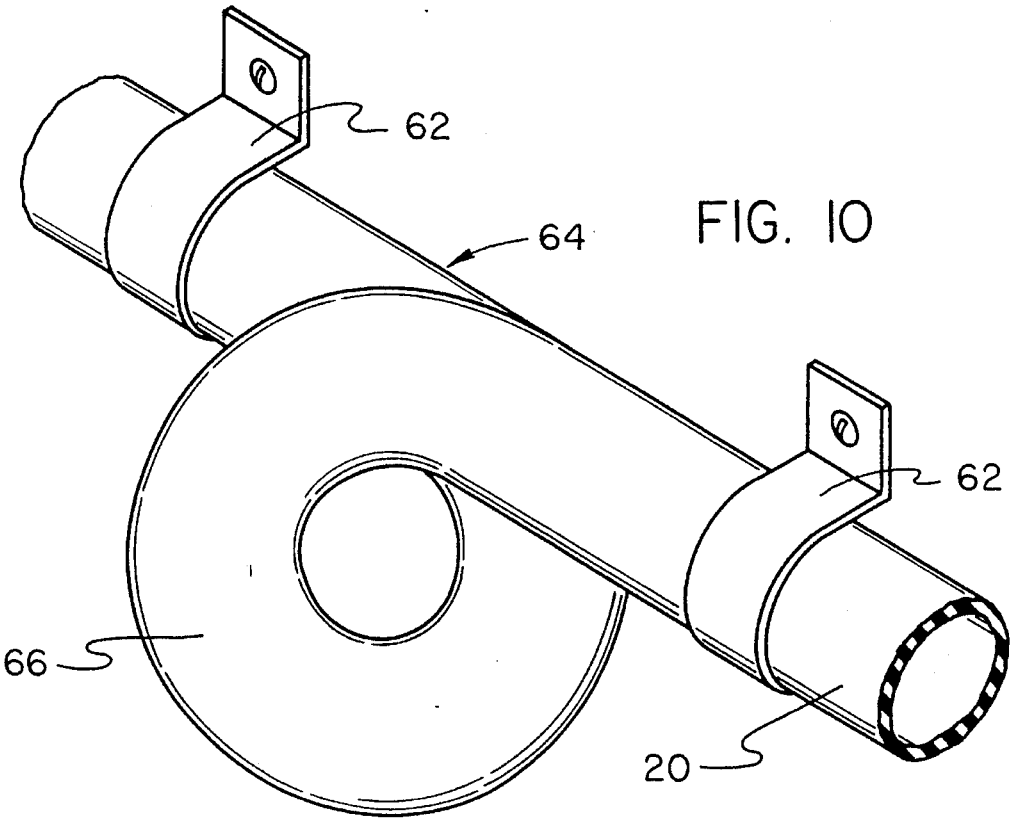
FIG. 10 is an isometric illustration of the trap means of the present invention.
Figure 11:
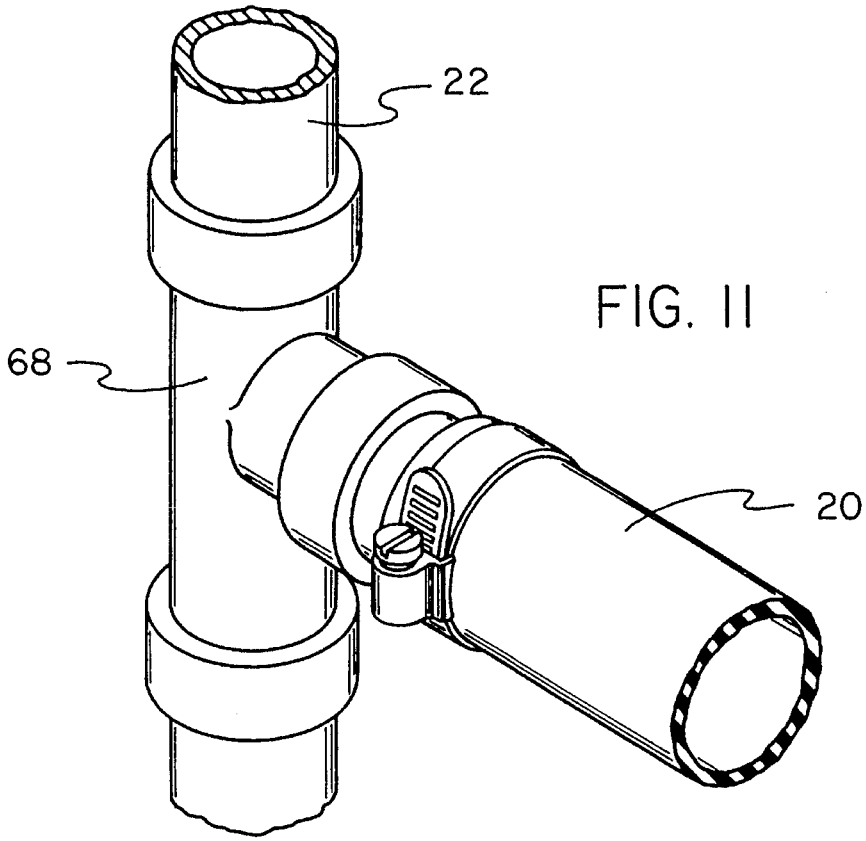
FIG. 11 is an isometric view of a connection between the drain conduit and the sink drain line.

Turning now to FIGS. 10 and 11, it can be shown that the drain conduit 20 communicating with a lower portion of the urinal bowl 12 extends from the urinal bowl and may be coupled along the vertical wall surface by a pair of brackets 62. Preferably, the drain conduit 20 includes a trap means 64 for fluidly blocking a passage of gas through the drain conduit 20. To this end, the trap means 64 comprises a helical bend 66 integrally formed within the drain conduit 20 such that gravity will maintain the predetermined amount of fluid within the helical bend to preclude a passage of sewage gas or the like through the drain conduit. As shown in FIG. 11, the drain conduit 20 can be easily connected to the sink drain line 22 by a drain line T-connector 68 interposed therebetween.

In use, the urinal 10 according to the present invention can be easily installed along a vertical wall surface of a conventional bathroom, as shown in FIG. 1. The urinal 10 may be utilized by both male and female individuals as an alternative to a conventional toilet, whereby flushing of the urinal 10 requires a substantially small amount of water compared to a flushing of the conventional toilet. Thus, the urinal 10 helps to reduce the water requirements of the bathroom by providing such an alternative.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A urinal comprising:

a urinal bowl, the urinal bowl including spaced side walls which are connected together by a front end of the urinal bowl, the urinal bowl further including a depending lip which extends from an upper perimeter of the side walls and the front end and into an interior of the urinal bowl, the depending lip being spaced from an interior surface of the urinal bowl, with the urinal bowl including a plurality of vent holes extending therethrough and into a space between the depending lip and the interior surface of said urinal bowl, the vent holes being operable to draw ambient air into the urinal bowl by a venturi vacuum created as flush water flows from the depending lip to the interior surface of the urinal bowl.

2. A urinal comprising:

a urinal bowl;

and, an adjustable mounting means for adjust ably mounting the urinal bowl to a vertical wall surface;

a drain conduit extending from said urinal and fluidly communicable with a drain line;

wherein said urinal bowl includes spaced side walls which are connected together by an arcuate front end of the urinal bowl, said side walls of said urinal bowl being spaced a distance apart so as to permit a female individual to squat over said urinal bowl;

wherein said urinal bowl further includes a depending lip which extends from an upper perimeter of said side walls and said arcuate front end and into an interior of said urinal bowl;

wherein said depending lip is spaced from an interior surface of said urinal bowl, and further wherein said urinal bowl includes a plurality of vent holes extending therethrough and into a space between said depending lip and said interior surface of said urinal bowl, said vent holes being operable to draw ambient air into said urinal bowl by a venturi vacuum created as flush water flows from said depending lip to said interior surface of said urinal bowl.

3. The urinal of claim 1, and further comprising a perimeter conduit mounted along an upper perimeter of said urinal bowl, said perimeter conduit including a plurality of spray holes directed therethrough which create a fine mist when a fluid is directed through said perimeter conduit; a flexible conduit extending into fluid communication with said perimeter conduit; a flush valve in fluid communication with said flexible conduit; and a water conduit extending from said flush valve and connectable to a water supply line.

4. The urinal of claim 3, wherein said adjustable mounting means comprises a mounting plate having a plurality of through-extending apertures permitting an attachment of the mounting plate to a vertical wall surface; a first adjustment leg pivotally mounted to the mounting plate; a second adjustment leg pivotally mounted to the mounting plate, the first and second adjustment legs projecting from the mounting plate in a spaced and parallel relationship; and a conical receiver pivotally mounted to said first and second adjustment legs, said conical receiver receiving the urinal bowl partially therewithin, wherein the adjustment legs and the pivotally attached conical receiver can be selectively positioned at a desired height relative to a floor surface of a bathroom structure.

5. The urinal of claim 3, and further comprising an adjustment plate, wherein said urinal bowl includes spaced side walls orthogonally projecting from said adjustment plate; and further wherein said adjustable mounting means comprises a mounting plate having a plurality of through-extending apertures permitting an attachment of said mounting plate to a vertical wall surface; an adjustment plate having a pair of elongated apertures extending in a vertical orientation adjustably coupled to said mounting plate, said mounting plate having a pair of threaded studs projecting through said elongated slots; and securing nuts engaged to said threaded studs to capture said adjustment plate between said securing nuts and said mounting plate, said urinal bowl being fixedly secured to said adjustment plate and projecting outwardly therefrom.

* * * * *